US007207389B2

(12) United States Patent
Foster et al.

(10) Patent No.: US 7,207,389 B2
(45) Date of Patent: Apr. 24, 2007

(54) HYBRID COILED TUBING/FLUID PUMPING UNIT

(75) Inventors: Robert Joseph Foster, Calgary (CA); Douglas Costall, Okotoks (CA)

(73) Assignee: Leader Energy Services Corp. (CA)

( * ) Notice: Subject to any disclaimer, the term of this patent is extended or adjusted under 35 U.S.C. 154(b) by 106 days.

(21) Appl. No.: 10/795,945

(22) Filed: Mar. 8, 2004

(65) Prior Publication Data

US 2005/0082064 A1 Apr. 21, 2005

(30) Foreign Application Priority Data

Mar. 7, 2003 (CA) ..... 2421376

(51) Int. Cl.
*E21B 21/16* (2006.01)
*E21B 37/00* (2006.01)
*E21B 36/00* (2006.01)

(52) U.S. Cl. ..... 166/302; 166/312; 166/77.2; 166/57

(58) Field of Classification Search ..... 166/379, 166/302, 303, 312, 311, 77.2, 77.1, 305.1, 166/57, 90.1
See application file for complete search history.

(56) References Cited

U.S. PATENT DOCUMENTS

| | | | | |
|---|---|---|---|---|
| 4,738,115 | A | 4/1988 | Goode | |
| 4,881,495 | A | 11/1989 | Tornare et al. | |
| 6,702,011 | B2 | 3/2004 | Crawford et al. | |
| 2003/0085036 | A1 * | 5/2003 | Curtis et al. | 166/267 |

FOREIGN PATENT DOCUMENTS

| | | | |
|---|---|---|---|
| CA | 2339685 | A1 | 6/2001 |

* cited by examiner

*Primary Examiner*—Kenneth Thompson
(74) *Attorney, Agent, or Firm*—Lerner, David, Littenberg, Krumholz & Mentlik, LLP

(57) ABSTRACT

Method and apparatus for servicing of a bore hole in the earth, comprising a first sub-assembly adapted for the insertion and removal of a continuous length of coiled tubing into and from the bore hole, a second sub-assembly adapted for the vaporization of liquified gas and the pumping of the resulting gas through the coiled tubing into the bore hole and a platform to support both the first and second sub-assemblies thereon.

37 Claims, 5 Drawing Sheets

HYBRID COILED TUBING/FLUID PUMPING UNIT

FIELD OF THE INVENTION

The present invention relates to a coiled tubing unit for use in the servicing of oil and gas wells and more particularly to a unit mounted on a single mobile platform capable of providing both coiled tubing and pressurized fluid injection with non-fired heat recovery.

BACKGROUND

Well bores require periodic maintenance to remove for example accumulated sediments or for a host of other reasons well known in the industry. When maintenance is required, it is the usual practice to remove existing pumping equipment from the wellhead, and to move in a service rig to maintain control over the well during servicing and to inject and remove the necessary tools and equipment required to complete the maintenance or servicing operations.

For well servicing and workovers, the use of coiled tubing is preferred. Coiled tubing is a single length of continuous unjointed tubing spooled onto a reel for storage in sufficient quantity to exceed the maximum depth of the well being serviced. Coiled tubing is favoured because its injection and withdrawal from the well can be accomplished more rapidly compared to conventional jointed pipe, and it is particularly well suited for use in underbalanced wells. However, as with conventional pipe, service fluids and wire lines for downhole tools and instruments pass through the tubing's interior. The tubing is wound on a reel or spool mounted on a wheeled trailer or the flatbed of a truck for transport. The coiled tubing unit will normally also include an injector for insertion and removal of the tubing from the wellbore and a guidearch which leads the tubing into the injector.

For a typical cleanout, the tubing is injected into the well and a pressurized fluid is pumped through the tubing to circulate the well contents out through the annulus between the tubing and the well bore. The fluid can be a liquid but is often an inert gas such as air, nitrogen or carbon dioxide.

As a cleanout fluid, air has the obvious advantage that it costs nothing and it works reasonably well particularly in shallow wells of less than 1200 meters in depth. In shallow wells, the ratio of oxygen to hydrocarbons is not critical and there is relatively little risk of explosion. In deeper wells however, partial pressures increase, and the concentration of oxygen and its reactiveness increase sharply. This creates a real risk of explosion and the oxygen's reactiveness can cause sever corrosion by the oxidation of metallic surfaces.

Another disadvantage to the use of air is that the equipment needed to compress and pump it adds substantially to the weight of a coiled tubing rig. A major issue with coiled tubing units is the amount of coil they can carry without exceeding load limits on both the trailer and public roadways. So called "bob tailed" coiled tubing units incorporate the air compressor. The compressors typically pump 300 to 650 standard cubic feet per minute (scfm) at a maximum pressure of approximately 2000 psi. This is not sufficient in itself to blow sand from deeper wells. To add more lifting capacity, soap is added to the air stream which produces a foam. The soap is stored in a tank, and the tank and compressor combined weight approximately 7500 lbs. (approximately 3400 kg), which reduces the amount of coil the unit can carry by the same amount. This limits deeper well applications.

These and other factors mitigate against the use of air for deep well applications and favour the use of nitrogen. Nitrogen is inert at all depths and creates a safer working environment around hydrocarbons. Its also non-corrosive. It is pumped at a volume of up to 1500 scfm at pressures up 5000 psi which is sufficient to blow sediments from the wellbore without the need for soap.

To complete a job using nitrogen, both a coiled tubing unit and a nitrogen unit are required on location. The two units are rigged together at the well site and as the coiled tubing is run into the well, the nitrogen is pumped through the tubing to extrude any fluids and/or solids accumulated in the well.

Nitrogen is normally stored and transported to the site as a liquid in a pressurized container forming part of the nitrogen rig, which also includes a tractor for moving the rig from job to job, a pumping unit and a heating unit to vaporize the nitrogen prior to injection through the coiled tubing and into the wellbore. The heater is normally an open flame unit and by regulation it must therefore be kept at a predetermined safe distance from the wellhead.

The above described setup has numerous disadvantages. Most obviously, operating costs for two rigs are high because of the extra personnel, fuel and equipment required. There is the added pollution and cost resulting from the use of two tractor units and an open flame heater. The mandated separation of the nitrogen and coiled tubing units greatly enlarges the footprint at the well site which sometimes necessitates enlarging the site. The high pressure tubing delivering the nitrogen gas to the coiled tubing unit is a hazard and setup and breakdown times before and after the job are increased.

SUMMARY OF THE INVENTION

The present invention seeks to overcome the above disadvantages by providing a hybrid coiled tubing/fluid pumping unit. The hybrid unit consists of a coiled tubing reel and injector, together with a nitrogen rig on a single platform. The nitrogen rig must have a non-fired heat recovery system between the pump and the coiled tubing to vaporize the nitrogen prior to injection. The term "single platform" can include both a single supporting surface such as a single trailer or flatbed, or two or more supporting surfaces that when in use can be situated close enough to one another that enlargement of the work site is unnecessary.

In operation, the hybrid coil tubing/nitrogen rig is driven to the well site requiring service. The unit has the capability of towing a pup trailer supporting the liquid nitrogen reservoir. Once at the site, the coiled tubing is deployed according to standard procedures known in the art; the tubing is delivered over a guide arch into the injector, and the injector then inserts the tubing into the bore. If the bore is underbalanced, a lubricator can be used in conjunction with the injector.

The outer end of the coiled tubing can be permanently connected to the nitrogen rig, thus eliminating the need to connect tubing which could potentially be a weak spot in a high pressure line. The permanent connection also limits the amount of high pressure tubing exposed at the work site, making for a safer environment. Because the heater used to vaporize the liquid nitrogen is non-fired, it can be deployed on the hybrid unit immediately adjacent the well bore, which greatly reduces the onsite footprint.

According to the present invention then, there is provided apparatus for the servicing of a bore hole in the earth, comprising a first sub-assembly adapted for the insertion and removal of a continuous length of coiled tubing into and from said bore hole; and a second sub-assembly adapted for the vaporization of liquified gas and the pumping of the resulting gas through said coiled tubing into said bore hole; and platform means adapted to support said first and second sub-assemblies thereon.

According to another aspect of the present invention, there is also provided a hybrid coiled tubing and pumping rig for servicing a well comprising a coiled tubing spool; coiled tubing wound about said spool; a coiled tubing injector for injecting said coiled tubing into said well; a guide arch for guiding said coiled tubing into said injector; a flameless heating unit for heating a liquified gas to produce gas; and a first pump for pumping said gas through said coiled tubing into said well wherein said spool, injector, flameless heating unit and first pump are supported on a single platform for transportation and use.

According to yet another aspect of the present invention, there is also provided a method for the servicing of a bore hole in the earth by injecting a pressurized gas thereinto, comprising the steps of supporting a first sub-assembly adapted for the insertion and removal of a continuous length of coiled tubing into and from said bore hole on a platform; and supporting a second sub-assembly adapted for the vaporization of liquified gas and the pumping of the resulting gas through said coiled tubing to said bore on said same platform.

BRIEF DESCRIPTION OF THE DRAWINGS

Preferred embodiments of the present invention will now be described in greater detail and will be better understood when read in conjunction with the following drawings, in which.

DETAILED DESCRIPTION OF THE PREFERRED EMBODIMENTS

Figure 1:
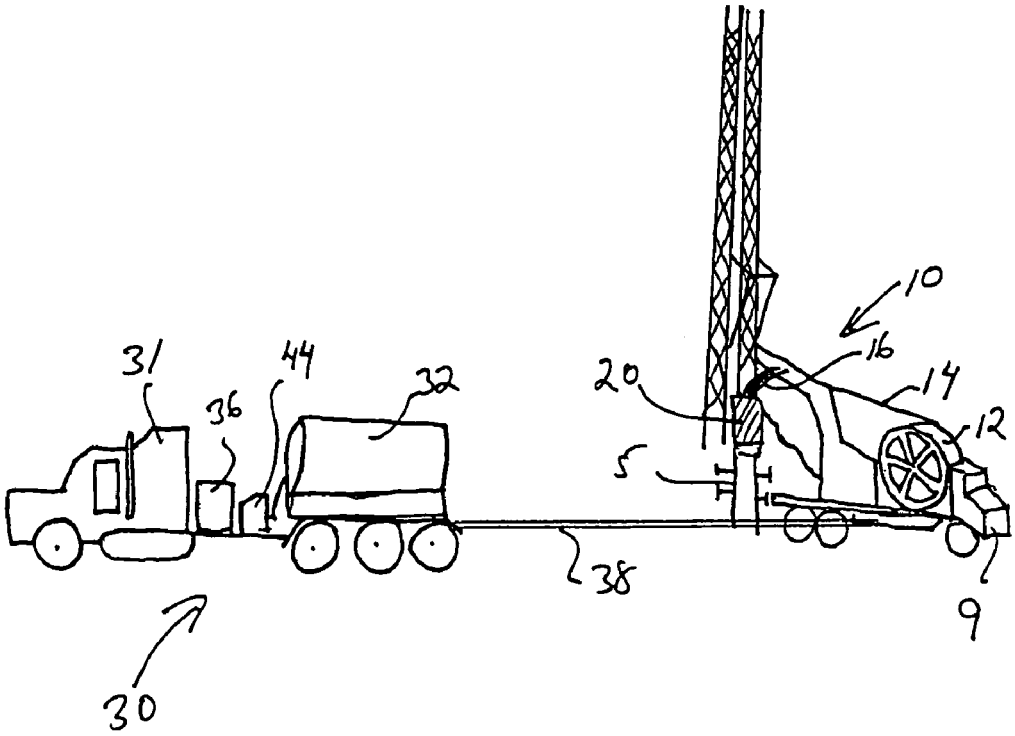
FIG. 1 is a perspective, partially schematical view of a well site set up for servicing using conventional nitrogen and coiled tubing units.

Reference is now made to the drawings. FIG. 1 shows prior art rigs and the ways these rigs are used. In particular, FIG. 1 shows a typical setup for a coil tubing unit 10 and a nitrogen rig 30.

Coil tubing unit 10 is situated adjacent to wellhead 5. The rig consists of a mobile tractor/trailer unit 9 fitted with a spool 12 for coiled tubing 14, a boom mounted guide arch 16 and a tubing injector 20 that inserts and removes the coiled tubing from the well bore. As will be appreciated, the tubing unit is shown in its working position. For transport and storage, the boom 18 is used to withdraw the guide arch and injector into a stored position on top of the trailer as best seen in FIG. 2.

A conventional stand-alone nitrogen rig 30 includes its own tractor trailer 31 with the trailer supporting a tank 32 for liquid nitrogen, a flame fired heater 36 for vaporizing the nitrogen and a high pressure pump 44 for pumping liquid nitrogen from tank 32 into the heater and then into and through the tubing. The pump will normally use the tractor's motor for power via an intervening hydraulic pump.

As seen in FIG. 1, the nitrogen rig is physically separated from the coiled tubing unit and the wellhead by the mandated distance required by law. The two units are rigged together using a high pressure line 38 to deliver pressurized gas from the pumper into the coiled tubing for injection down the well bore. If additional nitrogen is needed, rig 30 can be outfitted with a pup trailer as known in the art.

Figure 2:
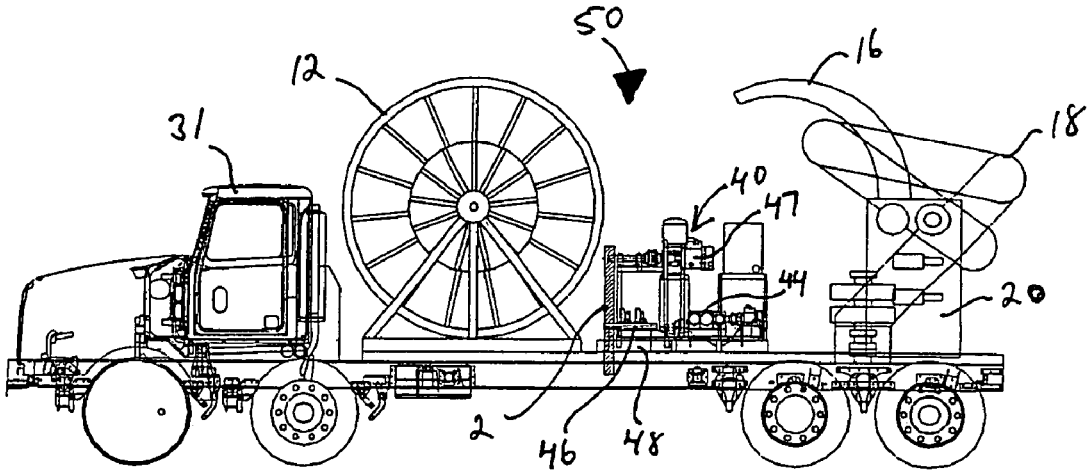
FIG. 2 is a side elevational partially schematical view of a hybrid coil tubing/pumping unit.

Reference is now made to FIG. 2 showing the hybrid unit 50 of the present invention which provides both tubing and pumping operations from a single platform. In FIG. 2, like numerals have been used to identify like elements.

The hybrid unit of the present invention includes all of the components of a conventional coiled tubing unit including spool 12, guide arch 16, injector 20 and boom 18 to deploy the arch and injector from the storage position shown in FIG. 2 to the operational position shown in FIG. 1. Unlike conventional rigs, however, the present unit also includes its own integrated nitrogen rig or skid 40 mounted on a sub-frame 48 that can be conveniently and securely attached to the unit's trailer in any known fashion. In one embodiment constructed by the applicant, rig 40 weighs approximately 2650 lbs. (approximately 1200 kg) compared to the 7500 lb. (approximately 3400 kg) weight of a combined air compressor and soap tank. The nitrogen rig will be described in greater detail below but it generally comprises the nitrogen pump 44, a flameless heat exchanger 46 for vaporizing the liquid nitrogen and a heat producing and engine loading device such as a water brake 47 used to load the truck's engine for increased heat production used to vaporize the nitrogen. Heat exchanger 46 is flameless for safety reasons. As aforesaid, regulations require that no flame be present within a predetermined distance of the wellhead. By using a flameless heater, hybrid unit 50 can be situated immediately adjacent the well in the same manner as a conventional coiled tubing unit.

The nitrogen is transported to the site as a compressed liquid which must be vaporized prior to injection into the well for clean outs. Assuming that up to 90,000 cubic feet of nitrogen gas will be pumped per hour, approximately 1.7 million British thermal units (btu) of heat per hour will be required to vaporize this amount of nitrogen. Some of this heat can be obtained from the truck's engine up to approximately 250,000 btu's with the bulk of the remaining heat being obtained from water brake 47, with perhaps some additional heat being scavenged from the hydraulic fluid used throughout the unit.

Power for the hybrid rig is taken from the truck's engine. As will be known in the art, the truck's gearbox (not shown) will have at least two auxiliary power take-offs. One is used to drive the coiled tubing hydraulics including the injector and the boom. This is a conventional hookup and therefore will not be described in further detail. The gearbox's other power outlet is used to supply driving force to the nitrogen rig through for example a belt or chain drive 2.

Figure 3:
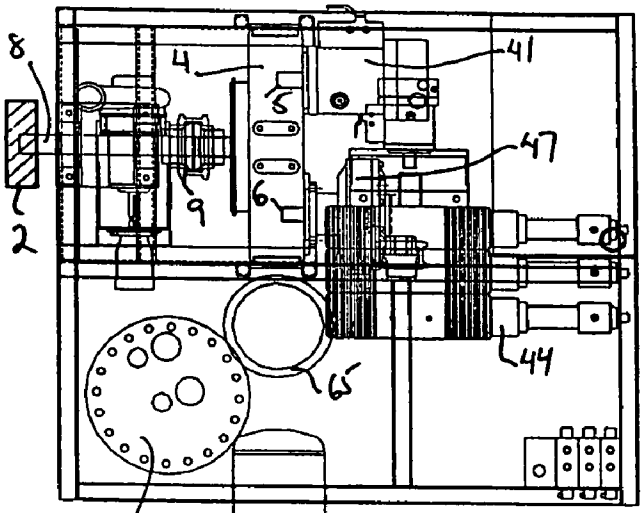
FIG. 3 is a top plan view of a nitrogen rig forming part of the present invention.
Figure 5:
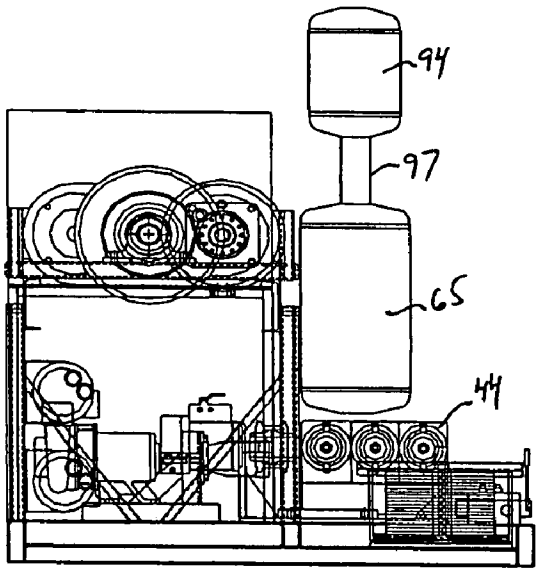
FIG. 5 is a rear elevational view of the nitrogen rig of FIG. 3.
Figure 4:
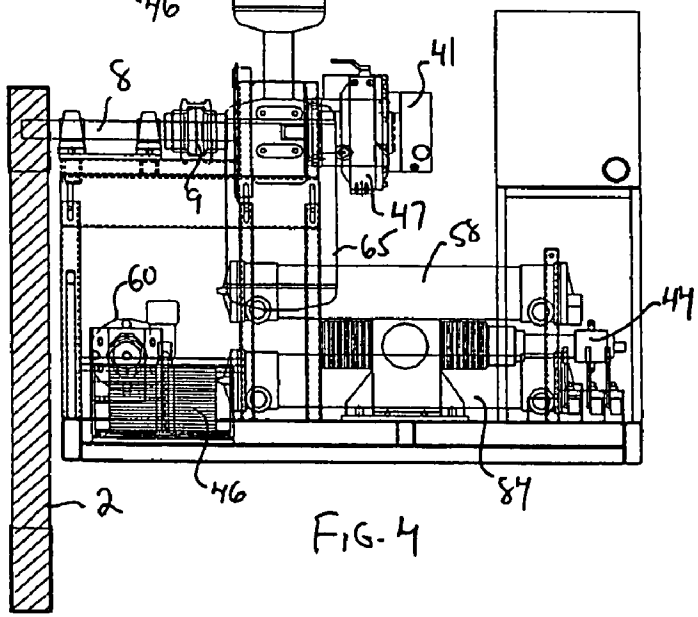
FIG. 4 is a side elevational view of the nitrogen rig of FIG. 3.
Figure 6:
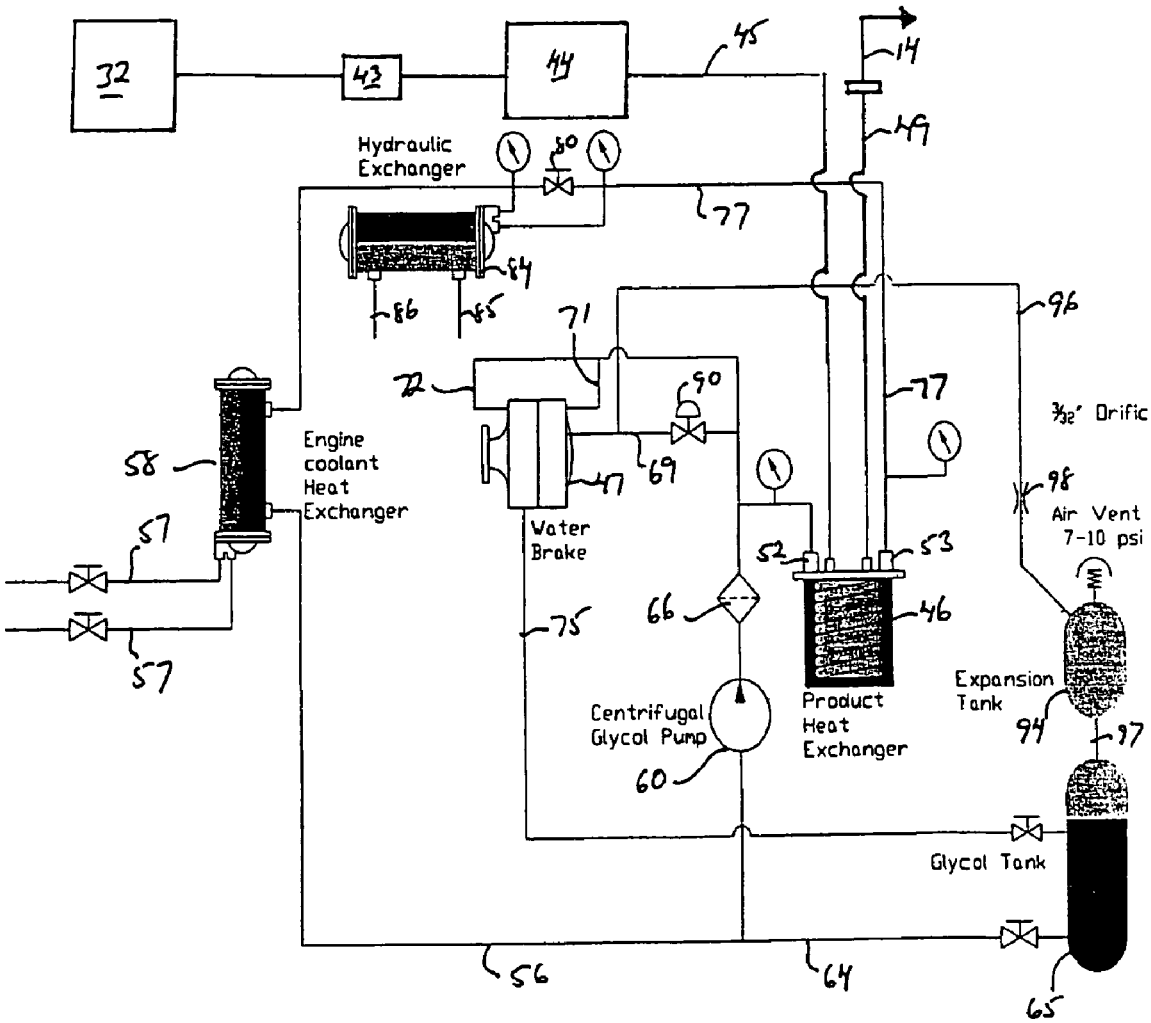
FIG. 6 is a schematic flow diagram of the nitrogen rig.

The nitrogen rig includes its own gearbox 4 having two outlets 5 and 6 seen most clearly in FIGS. 3 to 5. Drive 2 is connected to gearbox 4 by a shaft 8 and coupling 9. Gearbox 4, which can be a John Deere Funk™ model, distributes power between outlets 5 and 6. Water brake 47 is mounted onto outlet 6 which couples it to the truck's engine. A hydraulic pump 41, such as a Kawasaki, is mounted onto outlet 5. Pump 41 is used to drive the skid's hydraulics which include the triplex nitrogen pump 44, a boost pump 43 (shown schematically in FIG. 6) which is sometimes used to boost pressure to pump 44's intake and a centrifugal pump 60 (also shown schematically in FIG. 6) which circulates heated fluid through the heat exchange apparatus used to vaporize the liquid nitrogen as will now be described below with reference to FIG. 6.

Pump 44 pumps liquid nitrogen from tank 32 through high pressure supply line 45 into heat exchanger 46. A smaller boost pump 43 between tank 32 and pump 44 is actuated as required to ensure a continuous supply of liquid nitrogen at pump 44's intake and to boost pressure at the intake. The liquid nitrogen is vaporized in the heat exchanger and the resulting gas flows through conduit 49 which can be permanently or semi-permanently coupled to the outer end of coiled tubing 14.

Heat exchanger 46 includes an inlet 52 for hot fluid, which can be water but more typically will be glycol or a water/glycol mixture, and an outlet 53 for cold fluid. To heat the glycol, heat is derived from two principal sources, the truck's cooling system and water brake 47.

To maximize the production of heat from the truck engine's cooling system, it's preferred that the engine be fully loaded. Some of this load will come from the engine's peripherals such as the alternator, water pump and so forth, and some from the power required for the coiled tubing's hydraulics. These loads are not sufficient by themselves however to cause the engine to produce its maximum horsepower and heat output. The engine is therefore mechanically coupled to water brake 47 as described above to produce the required added load and to generate heat of its own.

Water brakes are well known in the art and therefore will not be described in great detail. Generally however they comprise a sealed chamber that is normally kept full of fluid. A plurality of radially extending, shaft mounted blades or rotor/stators are disposed to rotate within the chamber against the resistance of the fluid. The shaft is rotated by the motor being loaded. The mechanical energy from the spinning rotors is converted to heat energy in the fluid which is continuously circulated through the chamber to cool the water brake and its bearings and seals and to produce hot glycol for circulation through heat exchanger 46.

The present system incorporates a pump such as centrifugal pump 60 which circulates the glycol throughout the system. The pump is connected at its intake end to two sources of hot glycol. The first is supply line 56 which delivers heat extracted from hot engine coolant circulated through hoses 57 into an engine coolant heat exchanger 58. The second source is supply line 64 that delivers hot glycol from glycol tank 65.

Pump 60 forces the hot glycol through a filter 66 following which the flow is split up to three different ways. Part of the glycol is deviated into inlet 52 of heat exchanger 46. Another part is divided into feed line 69 that flows into water brake 47. Feed line 69 is typically an inch in diameter but this can vary. A smaller portion is diverted into ¼ inch lines 71 and 72 that connect with secondary inlets such as ⅛ inch orifices into the water brake that divert glycol against the water brake's seals and bearings when the water brake runs empty as will be described below in greater detail. Glycol entering the water brake through lines 69 and 71 and 72 drains through line 75 which flows the hot fluid back into glycol tank 65.

The cold fluid leaving heat exchanger 46 is circulated through line 77 in which it can be delivered directly to engine heat exchanger 58 for recovery of waste engine heat prior to circulation back into pump 60. Or, if valve 80 is closed, the fluid can be diverted through hydraulic heat exchanger 84. This exchanger can be used to scavenge heat from hot hydraulic fluid from the skid's hydraulic pumps and motors circulated through the exchanger via inlet 85 and outlet 86.

The flow rate through heat exchanger 46 is approximately 295 gallons of glycol per minute.

There are times when its unnecessary to operate the water brake. In conventional systems, this requires that the gearbox be adapted to disengage the brake from the truck's engine. These gearboxes however are heavy and expensive. To avoid this, the present water brake in a preferred embodiment of the present invention has been adapted to run empty which otherwise would normally cause the brake and its seals to burn out.

In the present system, the brake's aluminum housing is hardened to 85 Rockwell, and supply lines 71 and 72 continuously deliver a small amount of glycol to ⅛ inch orifices which internally direct the glycol against the seals and/or bearings. When valve 90 is closed to stop the delivery of glycol to the water brake, pressurized air (7 to 10 psi) from an expansion tank 94, arranged above and in fluid communication with glycol tank 65 through a 2 inch connecting line 97, flows through oneway check valve 98 and through air hose 96 into line 69 to purge the fluid from the brake. Check valve 98 prevents any reverse flow of glycol into the expansion tank when valve 90 is open during normal operation. Without fluid, the water brake simply spins without loading the truck's engine. The additional hardening of the water brake's housing and the continuous flow of glycol against the seals and bearings prevents burnout.

In operation, hybrid unit 50 can tow its own trailer supporting a liquid nitrogen tank 32. At the well site, the trailer is disconnected from the unit and conveniently located for connection to pump 44 and to boost pump 47 if one is needed.

Figure 7:
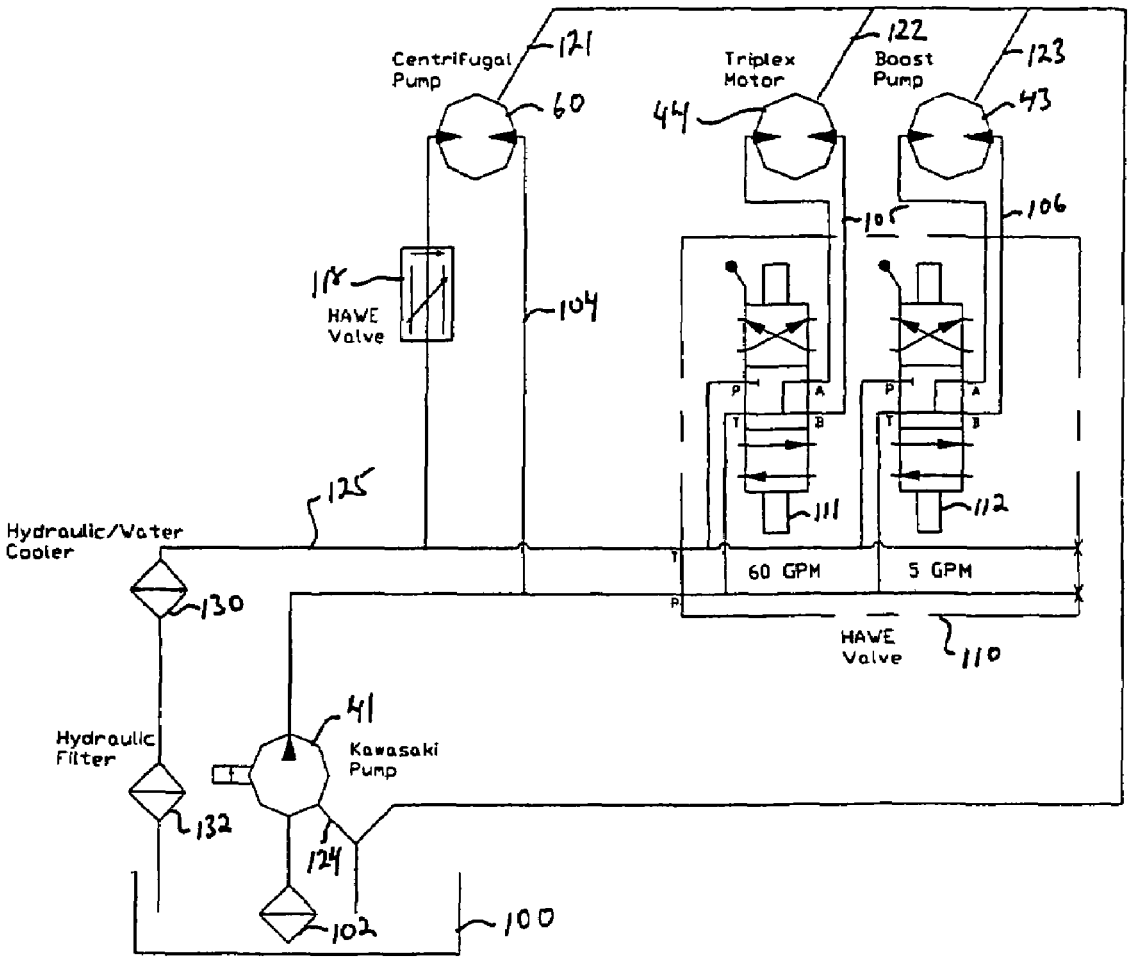
FIG. 7 is a hydraulic schematic of the nitrogen rig.
Figure 8:
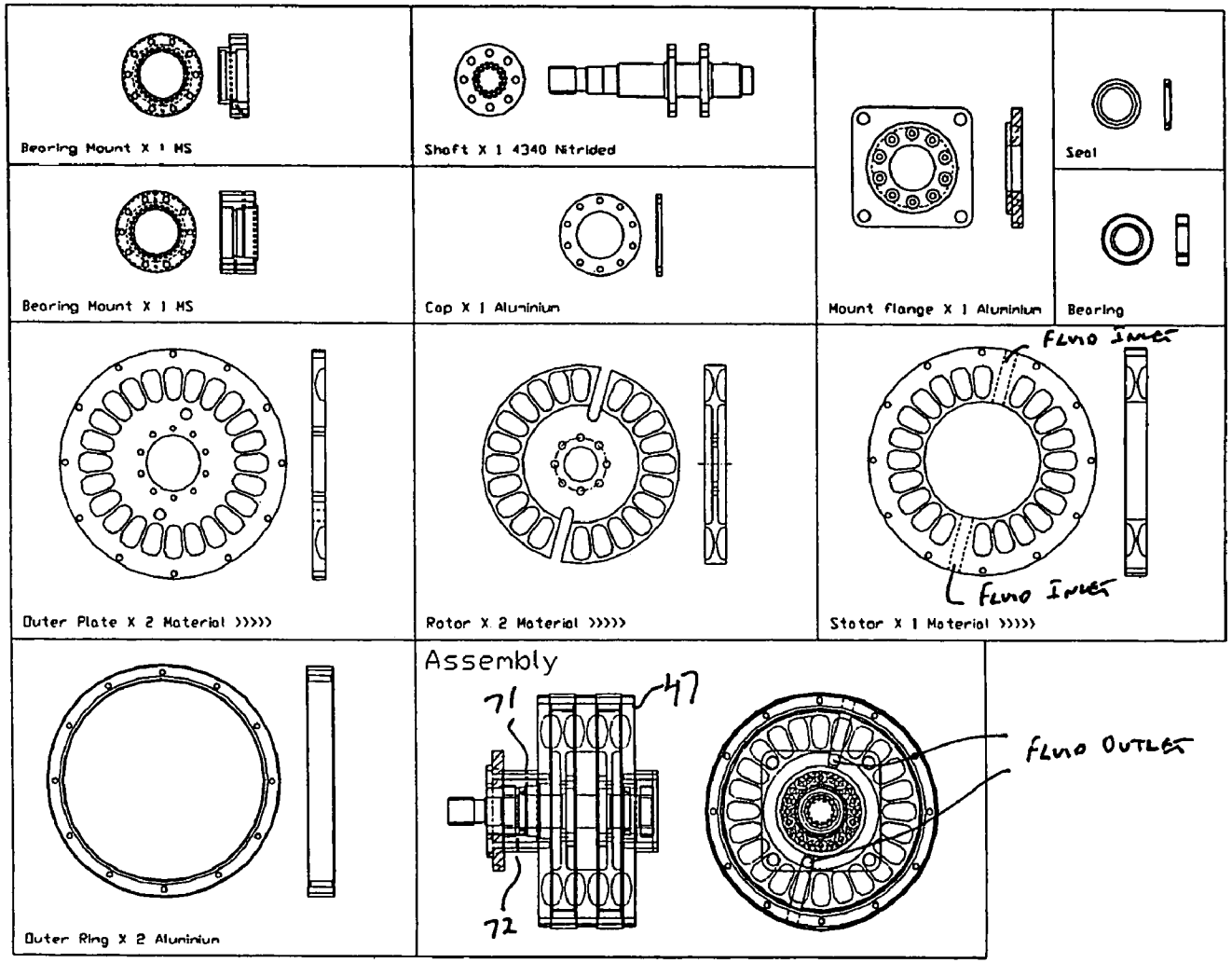
FIG. 8 is a pictorial representation of a water brake forming part of the nitrogen rig.

FIG. 7 is a schematic of the skid's hydraulic connections. Hydraulic fluid from reservoir 100 is drawn through filter 102, and is then pressurized by pump 41 for delivery to centrifugal pump 60, boost pump 43 and triplex motor 44 through supply lines 104, 105 and 106, respectively. Flow to boost pump 43 and motor 44 is regulated by a Hawe™ valve 110 having two pressure compensated spools 111 and 112 to maximize flow to the boost pump at five gallons per minute and to the triplex motor at 60 gallons per minute. Pressure compensated needle valve 118, such as a Parker™ PMS 800, regulates the flow of hydraulic fluid through pump 60. Any leakage from the motors is collected in lines 121, 122, 123 and 124 for drainage back to reservoir 101. Return line 125 for fluid from the various pumps and motors can include cooling unit 130 and a filter 132.

It is contemplated that the present rig can additionally incorporate an exhaust gas heat exchanger to recover even more engine waste heat for vaporizing the nitrogen.

As will be appreciated from the foregoing, the hybrid unit is largely self-contained, quickly set up and broken down, occupies a small footprint, requires only one crew, one motor and enhances on-site safety.

The above-described embodiments of the present invention are meant to be illustrative of preferred embodiments of the present invention and are not intended to limit the scope of the present invention. Various modifications, which would be readily apparent to one skilled in the art, are intended to be within the scope of the present invention. The only limitations to the scope of the present invention are set out in the following claims.

We claim:

1. Apparatus for the servicing of a bore hole in the earth, comprising:

a first sub-assembly adapted for the insertion and removal of a continuous length of coiled tubing into and from said bore hole; and a second sub-assembly adapted for the vaporization of liquified gas and the pumping of the resulting gas through said coiled tubing into said bore hole, said second sub-assembly including first heat exchanger means for vaporization of said liquefied gas, said heat exchanger means allowing heat transfer between a heat transferring fluid and said liguified gas, and means for loading said internal combustion engine, said means for loading comprising a water brake drivingly connected to said internal combustion engine; and platform means adapted to support said first and second sub-assemblies thereon.

2. The apparatus of claim 1 wherein said heat transferring fluid is heated in part by waste heat from an internal combustion engine.

3. The apparatus of claim 1 wherein at least a portion of said heat transferring fluid is circulated through said water brake for the transfer of heat to said fluid, said water break having a first inlet for said heat transferring fluid and an outlet for the discharge thereof.

4. The apparatus of claim 3 additionally comprising a first reservoir having an inlet for receiving said heat transferring fluid from said outlet of said water brake and an outlet for the discharge of said heat transferring fluid to said first heat exchanger.

5. The apparatus of claim 4 including a first pump for circulating said heat exchanging fluid through said water brake and said first heat exchanger.

6. The apparatus of claim 5 wherein said first pump has an intake in fluid communication with said outlet of said first reservoir and a discharge in fluid communication with said inlet to said first heat exchanger and said first inlet to said water brake.

7. The apparatus of claim 6 additionally comprising a second heat exchanger having first and second inlets and first and second outlets, said first inlet being in fluid communication with said internal combustion engine to receive heated coolant therefrom, said first outlet being in fluid communication with said internal combustion engine for the return of said coolant thereto, said second outlet being in fluid communication with said inlet to said first pump and said second inlet being in fluid communication with an outlet of said first heat exchanger for receiving said heat transferring fluid therefrom.

8. The apparatus of claim 6 wherein said water brake includes one or more secondary inlets in fluid communication with said discharge of said first pump, and sized for the delivery of a reduced amount of heat transferring fluid into said water brake.

9. The apparatus of claim 7 including valve means disposed between said first pump and said first inlet of said water brake, said valve being operable to control the flow of said heat transferring fluid through said first inlet of said water brake.

10. The apparatus of claim 8 wherein, when said valve means are closed, heat transferring fluid continues to be discharged in a reduced amount into said water brake through said secondary inlets for cooling and lubrication.

11. The apparatus of claim 9 wherein said heat transferring fluid flowing through said secondary inlets is directed at seals and/or bearings in said water brake.

12. The apparatus of claim 10 including an air line for delivering pressurized air into said first inlet of said water brake when said valve means are closed, wherein said pressurized air forces said heat transferring fluid from said water brake to substantially empty the same.

13. The apparatus of claim 11 wherein said substantially empty water brake imposes reduced or no loading on said internal combustion engine without being drivingly disconnected therefrom.

14. The apparatus of claim 13 including a vessel for said pressurized air, said vessel being located above said first reservoir and having an inlet in fluid communication therewith and an outlet for delivery of said pressurized air through said air line to said water brake.

15. The apparatus of claim 14 wherein said air line includes a one-way check valve therein permitting the flow of pressurized air into said water brake but preventing the flow of heat transferring fluid into said vessel.

16. The apparatus of any of claim 7 including a second pump for pumping said liquified gas through said first heat exchanger and into said bore hole.

17. The apparatus of claim 16 including a tank for said liquified gas.

18. The apparatus of claim 17 including a third pump disposed in fluid communication between said tank and said second pump for boosting the pressure of said liquified gas into said second pump.

19. The apparatus of claim 18 wherein said first, second and third pumps are hydraulically actuated.

20. The apparatus of claim 19 including a hydraulic pump for actuation of said first, second and third pumps.

21. The apparatus of claim 20 wherein said hydraulic pump is drivingly connected to said internal combustion engine.

22. The apparatus of claim 21 including a gearbox drivingly connected to said internal combustion engine, said gearbox having two outlets, said water brake being drivingly connected to one of said outlets and said hydraulic motor being drivingly connected to the other of said outlets.

23. The apparatus of claim 22 including a third heat exchanger for transferring heat from hydraulic fluid circulating through said first, second and third pumps to said heat transferring fluid.

24. The apparatus of claim 1 wherein said liquified gas is liquified nitrogen.

25. A hybrid coiled tubing and pumping rig for servicing a well comprising:

a coiled tubing spool;

coiled tubing wound about said spool;

a coiled tubing injector for injecting said coiled tubing into said well;

a guide arch for guiding said coiled tubing into said injector;

a flameless heating unit for heating a liquified gas to produce gas, said flameless heating unit including:

a heat exchanger for vaporizing said liquified gas by heat transfer between a heat exchanging fluid and said liguified gas;

a source of heat for said heat exchanging fluid including a water brake drivingly connected to a prime mover;

a first pump for pumping said heat exchanging fluid through said heat exchanger and said water brake; and a reservoir for said heat exchanging fluid wherein said heat exchanging fluid is circulated from said reservoir, through said second pump, said heat exchanger, said water brake and back to said reservoir; and a second pump for pumping said gas through said coiled tubing into said well wherein said spool, injector, flameless heating unit and first pump are supported on a single platform for transportation and use.

26. The hybrid rig of claim 25 wherein said second pump additionally pumps said liquified gas through said flameless heating unit.

27. The hybrid rig of claim 25 wherein said source of heat additionally includes a second heat exchanger for extracting heat from said prime mover's coolant.

28. The hybrid rig of claim 27 wherein said first pump circulates at least a portion of said heat exchanging fluid through said water brake and another portion of said fluid through said second heat exchanger.

29. The hybrid rig of claim 28 wherein said flameless heating unit additionally comprises:

a supply line providing fluid communication between said second pump and a first inlet into said water brake;

a valve in said supply line, said valve allowing said heat exchanging fluid to flow into said first inlet of said water brake when open and stopping said flow when closed;

an airline connected to said supply line between said water brake and said valve for the flow of pressurized air into said firs: inlet;

a one way check valve in said airline to prevent the reverse flow of said heat exchanging fluid therethrough;

a return line providing fluid communication between an outlet from said water brake and said reservoir; and an expansion tank for said pressurized air connected above said reservoir in fluid communication therewith, whereby opening said valve allows said heat exchanging fluid to flow through said water brake and closing said valve allows said pressurized air to flow into said water brake for purging said heat exchanging fluid therefrom.

30. The hybrid rig of claim 29 wherein said source of heat includes a third heat exchanger for extracting heat from hydraulic fluid used for actuating said first and second pumps.

31. The hybrid rig of claim 29 wherein said water brake additionally comprises:

a hardened housing;

bearings fluid seals; and one or more additional inlets for said heat exchanging fluid to cool said bearings and seals, whereby said hardened housing and said fluid cooled bearings and seals allow said water brake to run when said valve is closed for unloading said prime mover without disconnecting said water brake therefrom.

32. The hybrid rig of claim 28 wherein said coiled tubing is directly coupled to said flameless heating unit.

33. The hybrid rig of claim 28 wherein said liquified gas is liquid nitrogen.

34. The hybrid rig of claim 33 wherein said heat exchanging fluid is water, glycol or a mixture thereof.

35. The hybrid rig of claim 34 additionally comprising a hydraulically actuated boom.

36. The hybrid rig of claim 35 wherein said prime mover provides power for actuation of said spool, tubing injector and boom.

37. A method for the servicing of a bore hole in the earth by injecting a pressurized gas thereinto, comprising the steps of supporting a first sub-assembly adapted for the insertion and removal of a continuous length of coiled tubing into and from said bore hole on a platform; and supporting a second sub-assembly adapted for the vaporization of liquified gas and the pumping of the resulting gas through said coiled tubing to said bore on said same platform, said vaporization of said liquified gas comprising the additional steps of circulating said liquified gas through a heat exchanger in which said liquefied gas is vaporized by heat transferred from a heat transferring fluid and heating said heat transferring fluid by the circulation thereof through a water brake drivingly connected to a prime mover.

* * * * *

UNITED STATES PATENT AND TRADEMARK OFFICE

CERTIFICATE OF CORRECTION

PATENT NO. : 7,207,389 B2
APPLICATION NO. : 10/795945
DATED : April 24, 2007
INVENTOR(S) : Robert Joseph Foster and Douglas Costall It is certified that error appears in the above-identified patent and that said Letters Patent is hereby corrected as shown below:

Col. 1, Line 14, “remove for” should read --remove, for--.
Col. 1, Line 15, “example accumulated” should read --example, accumulated--.
Col. 1, Line 57, “so called” should read --so-called--.
Col. 1, Line 64, “weight” should read --weigh--.
Col. 2, Line 5, insert --to-- after “up”.
Col. 4, Line 61, “through for example” should read --through, for example,--.
Col. 5, Line 37, “Generally however” should read --Generally, however,--.
Col. 6, Line 12, “its” should read --it’s--.
Col. 6, Line 28, “oneway” should read --one way--.
Col. 6, Line 35, “prevents” should read --prevent--.
Col. 7, Line 16, “liguified” should read --liquified--.
Col. 8, Line 22, delete “any of”.
Col. 8, Line 61, “liguified” should read --liquified--.
Col. 9, Line 27, “firs:” should read --first--.

Signed and Sealed this

Twentieth Day of May, 2008

JON W. DUDAS
*Director of the United States Patent and Trademark Office*